US006832213B2

(12) United States Patent
Freeman et al.

(10) Patent No.: US 6,832,213 B2
(45) **Date of Patent: *Dec. 14, 2004**

(54) MAILING MACHINE INCLUDING DIMENSIONAL RATING CAPABILITY

(75) Inventors: Gerald C. Freeman, Norwalk, CT (US); Edilberto I. Salazar, Brookfield, CT (US); Richard P. Schoonmaker, Wilton, CT (US); Kenneth A. Schulz, Bethel, CT (US)

(73) Assignee: Pitney Bowes Inc., Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 170 days.

(21) Appl. No.: 09/303,983

(22) Filed: May 3, 1999

(65) Prior Publication Data

US 2002/0198852 A1 Dec. 26, 2002

Related U.S. Application Data

(63) Continuation of application No. 08/826,325, filed on Mar. 27, 1997, now Pat. No. 6,006,210.

(51) Int. Cl.[7] ..... G07B 17/00
(52) U.S. Cl. ..... 705/410; 705/401
(58) Field of Search ..... 705/401, 402, 705/406, 407, 410

(56) References Cited

U.S. PATENT DOCUMENTS

| | | | | |
|---|---|---|---|---|
| 2,072,235 A | | 3/1937 | Wormser | 271/57 |
| 3,436,968 A | | 4/1969 | Unger et al. | 177/220 |
| 3,513,444 A | | 5/1970 | Henderson et al. | 356/157 |
| 4,201,378 A | | 5/1980 | Hams | 271/261 |
| 4,286,325 A | | 8/1981 | Dlugos et al. | 364/466 |
| 4,868,757 A | | 9/1989 | Gil | 364/464.03 |
| 4,944,505 A | | 7/1990 | Sherman, III | 271/265 |
| 4,978,114 A | * | 12/1990 | Holbrook | 705/401 |
| 5,121,328 A | | 6/1992 | Sakai et al. | 364/464.03 |
| 5,154,246 A | | 10/1992 | DiGiulio et al. | 177/25.15 |
| 5,178,224 A | | 1/1993 | DiGiulio et al. | 177/25.15 |
| 5,229,932 A | | 7/1993 | Connell et al. | 364/401 |
| 5,236,072 A | | 8/1993 | Cargill | 194/207 |
| 5,264,665 A | | 11/1993 | Delfer, III | 177/25.15 |
| 5,331,538 A | | 7/1994 | DiGiulio et al. | 364/134 |
| 5,448,641 A | | 9/1995 | Pintsov et al. | 380/51 |
| 5,535,127 A | | 7/1996 | Uno et al. | 364/464.02 |
| 5,740,728 A | * | 4/1998 | DeBarber et al. | 705/401 |
| 5,793,652 A | | 8/1998 | DeBarber et al. | 364/567 |
| 5,808,912 A | | 9/1998 | Dlugos et al. | 364/562 |

FOREIGN PATENT DOCUMENTS

| | | | |
|---|---|---|---|
| EP | 0 548 464 A1 | 8/1992 | |
| EP | 0871145 | * 10/1998 | |
| GB | 2 236 | 10/1990 | G01B/7/06 |

* cited by examiner

*Primary Examiner*—Sam Rimell
(74) *Attorney, Agent, or Firm*—Angelo N. Chaclas; Charles R. Malandra; George M. Macdonald

(57) ABSTRACT

A mailing machine comprising a device for feeding an envelope having a width in a path of travel; a device for determining the width of the envelope; and a control device in operative communication with the determining device for using the width of the envelope to ascertain a proper amount of postage to be applied to the envelope. According to a first embodiment, the determining device includes a sensor array located transverse to the path of travel for detecting the presence of the envelope where the sensor array includes an inner plurality of sensors and an outer plurality of sensors located further away from a registration wall than the inner plurality of sensors. According to a second embodiment, the determining device includes a first sensor for detecting a lead edge of the envelope and a sensor line located downstream in the path of travel from the first sensor and at an angle to the path of travel so as to detect a lead corner of the envelope.

4 Claims, 4 Drawing Sheets

PRINT HEAD CONTROLLER
SENSOR CONTROLLER
MOTOR CONTROLLER
RATE MODULE
ACCOUNTING MODULE
A
10
20
100
200
210
220
222
230
232
234
260
300
310
320
330
340
350
400
410
412
414
430
432
434
450
470
500
502
504
520

(DIMENSIONAL RATING REQUIREMENTS)

MAILING MACHINE INCLUDING DIMENSIONAL RATING CAPABILITY

This application is a continuation of application code/Ser. No. 08/826,325 filed on Mar. 27, 1997, now U.S. Pat. No. 6,006,210, entitled MAILING MACHINE INCLUDING DIMENSIONAL RATING CAPABILITY.

FIELD OF THE INVENTION

This invention relates to determining rating parameters for a mailpiece. More particularly, this invention is directed to a mailing machine including dimensional rating capability for determining the width of a mailpiece and classifying the mailpiece according to its width so that a proper amount of postage may be applied.

BACKGROUND OF THE INVENTION

Mailing machines are well known in the art. Generally, mailing machines are readily available from manufacturers such as Pitney Bowes Inc. of Stamford, Conn. Mailing machines often include a variety of different modules which automate the processes of producing mailpieces. The typical mailing machine includes a variety of different modules or sub-systems where each module performs a different task on the mailpiece, such as: singulating (separating the mailpieces one at a time from a stack of mailpieces), weighing, moistening/sealing (wetting and closing the glued flap of an envelope), applying evidence of postage, accounting for postage used and stacking finished mailpieces. However, the exact configuration of each mailing machine is particular to the needs of the user. Customarily, the mailing machine also includes a transport apparatus which feeds the mailpieces in a path of travel through the successive modules of the mailing machine.

Various postal services throughout the world have developed rating systems which are used to determine the fee associated with the delivery of a particular mailpiece. Generally, the rating systems utilize a variety of different parameters or factors which influence the fee structure, such as: desired class of service (as examples, first class or third class in the United States), weight of the mailpiece, destination of the mailpiece and size of the mailpiece. The postal services generally communicate the rating systems in the form of tables or charts which are updated periodically to reflect new pricing or changes in the rating parameters.

A number of different devices and systems have been developed to assist mailers in determining the proper amount of postage for each particular mailpiece. For example, a scale may be utilized for determining the weight of the mailpiece which is used as one input to the rating system to calculate the proper amount of postage. As another example, a ruler may be used to measure the width of the mailpiece which is used as another input to the rating system to calculate the proper amount of postage. Generally, the fees of the various postal services are higher for heavier and larger mailpieces due to extra costs incurred in handling and transportation.

Such simple devices such as a scale and a ruler may be suitable for low volume conscientious mailers who send few mailpieces over a given period of time. However, such simple devices are not suitable for all mailers. For example, if the mailer employs operators who are not conscientious, then human error will result in incorrect readings from the scale and the ruler. If the incorrect readings lead to insufficient postage being applied, then the mailpiece will be returned to the mailer causing delays. If the incorrect readings lead to excess postage being applied, then the mailpiece will be delivered, but the mailer will have wasted money. Either scenario is undesirable to the mailer. As another example, the mailer who sends a significant number of mailpieces on a regular basis will experience increased costs and delays due to the inefficiencies of handling large volumes of mailpieces manually.

Some prior art mailing machines have been developed which have the capability for feeding mailpieces of different sizes, commonly referred to as mixed mail. An example of such prior art mailing machines is the Paragon™ available from Pitney Bowes in Stamford, Conn. Although this mailing machine generally works well by applying proper postage to mailpieces of different thicknesses and weights, it suffers from some limitations. The Paragon™ employs a single sensor spaced at a distance of 15.56 centimeters (cm) (6.125 inches) from the registration wall. Thus, whether a mailpiece is under or over 15.56 cm can be determined, but the precise width of the mailpiece cannot be determined. Since the United States has a single price point for determining rating according to mailpiece width which is located at 15.56 cm, this single sensor is generally sufficient for applying appropriate rating to envelopes in the United States. However, it is not adequate for applying appropriate rating in other postal markets.

For example, the postal services of several countries (Germany, Italy, etc.) have established a plurality of price points relating to mailpiece width in their rating system, respectively. Moreover, the various postal services have not established these price points in the same location. As a result, mailpieces must be manually sorted according to their widths and according to the applicable postal service rating system prior to processing because the mailing machine does not have any capability to detect the precise width of the mailpieces. Therefore, the mailing machine can only properly handling mixed mailpieces which are all within the same range or width category within the applicable rating system.

Therefore, there is a need for a mailing machine including dimensional rating capability so that the need for presorting is reduced.

SUMMARY OF THE INVENTION

The present invention provides a mailing machine including dimensional rating capability for use in ascertaining the proper amount of postage to be applied to an envelope and a method of ascertaining the width of an envelope and the proper amount of postage to be applied to an envelope in a mailing machine.

In accordance with the present invention, the mailing machine comprising a device for feeding an envelope having a width in a path of travel; a device for determining the width of the envelope; and a control device in operative communication with the determining device for using the width of the envelope to ascertain a proper amount of postage to be applied to the envelope. According to a first embodiment, the determining device includes a sensor array located transverse to the path of travel for detecting the presence of the envelope where the sensor array includes an inner plurality of sensors and an outer plurality of sensors located further away from a registration wall than the inner plurality of sensors. According to a second embodiment, the determining device includes a first sensor for detecting a lead edge of the envelope and a sensor line located downstream in the path of travel from the first sensor and at an angle to the path of travel so as to detect a lead corner of the envelope.

In accordance with the present invention, a method of determining a proper amount of postage for an envelope in a mailing machine is provided, the method comprises the step(s) of: feeding the envelope having a width in a path of travel; determining the width of the envelope; and using the width of the envelope to ascertain the proper amount of postage to be applied to the envelope. According to a first embodiment, the method further comprises the step(s) of: providing an array of sensors located substantially transverse to the path of travel so as to detect the presence of the envelope; and wherein the array of sensors includes an inner plurality of sensors and an outer plurality of sensors located further from the registration wall than the inner plurality of sensors. According to a second embodiment, the method further comprises the step(s) of: providing a first sensor for detecting a lead edge of the envelope; and providing an array of sensors located downstream in the path of travel from the first sensor and at an angle to the path of travel so as to detect a lead corner of the envelope.

Therefore, it is now apparent that the invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
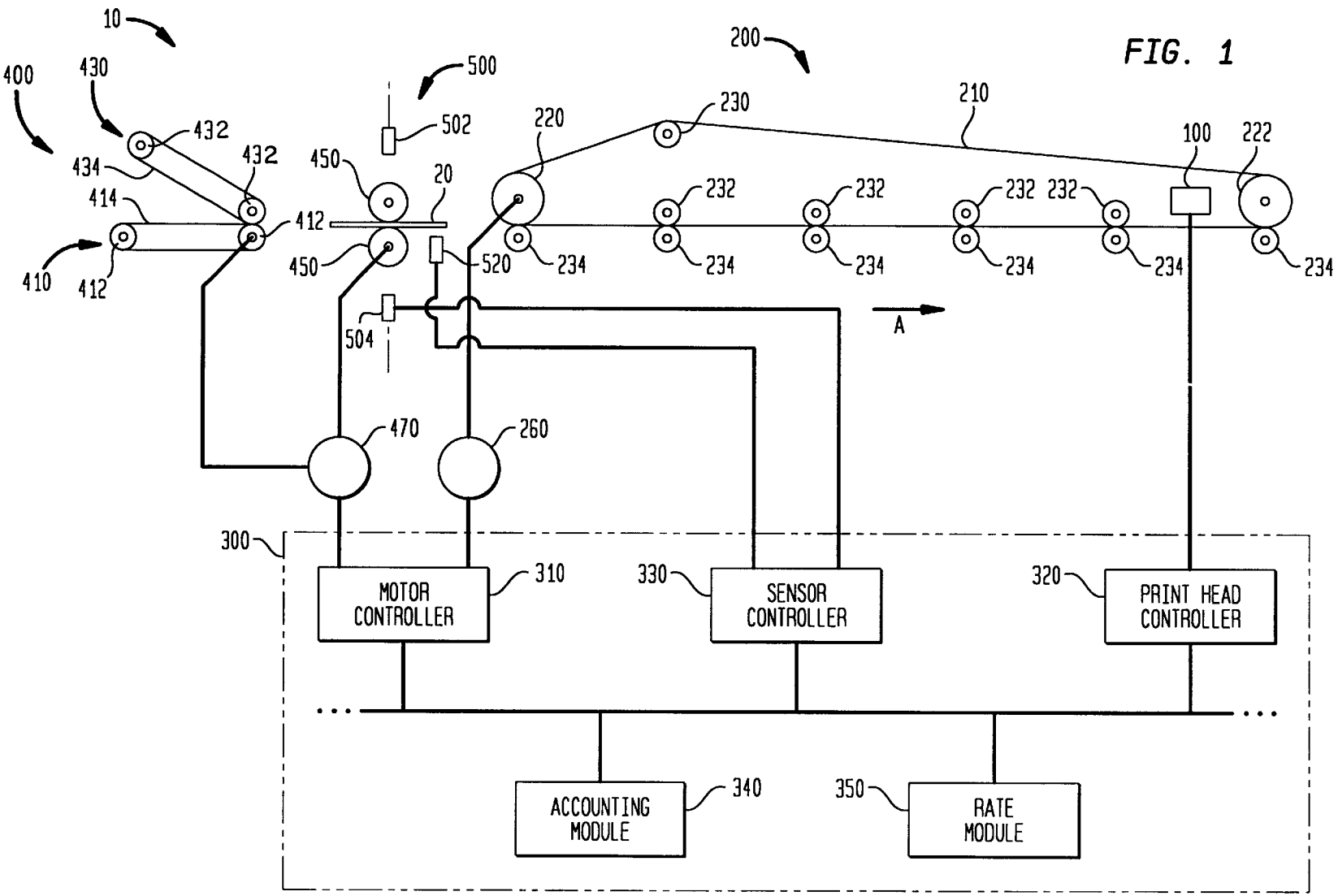
FIG. 1 is a simplified schematic of a front elevational view of a mailing machine which incorporates a first embodiment of the present invention.

Referring to FIG. 1, a mailing machine 10 including a print head module 100, a conveyor apparatus 200, a micro control system 300 and a singulator module 400 is shown. Other modules of the mailing machine 10, such as those described above, have not been shown for the sake of clarity. The singulator module 400 receives a stack of envelopes (not shown), or other mailpieces such as postcards, folders and the like, and separates and feeds them at variable speed in seriatim fashion (one at a time) in a path of travel as indicated by arrow A. Downstream from the path of travel, the conveyor apparatus 200 feeds envelopes at constant speed in the path of travel along a deck (not shown) past the print head module 100 so that an indicia of postage can be printed on each envelope 20. Together, the singulator module 400 and the conveyor module 200 make up a transport apparatus for feeding the envelopes 20 through the various modules of the mailing machine 10.

The print head module 100 is of an ink jet print head type having a plurality of ink jet nozzles (not shown) for ejecting droplets of ink in response to appropriate signals. The print head module 100 may be of any conventional type such as those commonly available from printer suppliers. Since the print head module 100 does not constitute a part of the present invention, further description is unnecessary. So that the postal indicia is spaced a predetermined distance from the top edge of the envelope 20, the envelope 20 is aligned along its top edge with a registration wall (not shown) as it is fed through the mailing machine 10. The print head module 100 is accordingly spaced a predetermined distance transverse to the registration wall.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor as the feeder assembly 410.

Since the details of the singulator module 400 are not necessary for an understanding of the present invention, no further description will be provided. However, an example of a singulator module suitable for use in conjunction with the present invention is described in U.S. Pat. No. 4,7978, 114, entitled REVERSE BELT SINGULATING APPARATUS, the disclosure of which is specifically incorporated herein by reference.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the take-away roller drive train so that the take-away rollers 450 operate at a higher speed than the feeder assembly 410. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The mailing machine 10 further includes a sensor module 500 which is substantially in alignment with the nip of take-away rollers 450 and a sensor array assembly 520, both for detecting the presence of the envelope 20. Preferably, the sensor module 500 is of any conventional optical type which includes a light emitter 502 and a light detector 504. Generally, the light emitter 502 and the light detector are located in opposed relationship on opposite sides of the path of travel so that the envelope 20 passes therebetween. By measuring the amount of light that the light detector 504 receives, the presence or absence of the envelope 20 can be determined.

Generally, by detecting the lead and trail edges of the envelope 20, the sensor module 500 provides signals to the micro control system 300 which are used to determine the length of the envelope 20. The amount of time that passes between the lead edge detection and the trail edge detection, along with the speed at which the envelope 20 is being fed, can be used to determine the length of the envelope 20. Additionally, using similar techniques, the sensor module 500 measures the length of the gaps between envelopes 20 by detecting the trail edge of a first envelope and the lead edge of a subsequent envelope. Alternatively, an encoder system (not shown) can be used to measure the envelope 20 and gap lengths by counting the number of encoder pulses which are directly related to a known amount of rotation of the take-away rollers 450. Thus, the lengths can be determined in this fashion. Such techniques are well known in the art.

Figure 2:
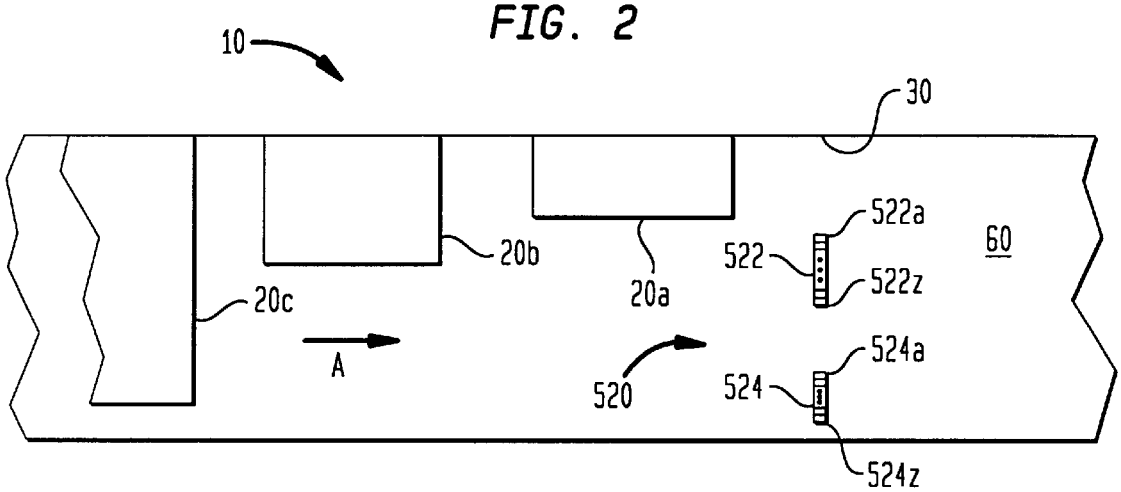
FIG. 2 is a simplified schematic of a plan view of a sequence of envelopes in transit through the mailing machine in accordance with the first embodiment of the present invention.

Referring to FIGS. 1 and 2, the sensor array assembly 520 includes an inner array 522 and an outer array 524 both mounted in any conventional fashion to be flush with the deck 60 and extending generally transverse to the path of travel so as to be substantially perpendicular to the registration wall 30. Preferably, the inner array 522 and the outer array 524 both include a plurality of conventional reflective optical type sensors spaced along the length of each array 522 and 524. Each sensor includes a light emitter (not shown) and a respective light detector (not shown). Generally, the light emitter and the light detector are located adjacent to each other so that the light detector receives light reflected back from the light emitter. By measuring the amount of light that the light detector receives, the presence or absence of the envelope 20 can be determined. A greater amount of light indicates that the envelope 20 is present while a lesser amount of light indicates that the envelope 20 is not present.

In the preferred embodiment, the inner array 522 and the outer array 524 both incorporate the plurality of sensors spaced 1 millimeter (mm) apart from each other. Furthermore, the inner array 522 includes a first sensor 522*a* set at a distance of 9.0 centimeters (cm) from the registration wall 30 and a last sensor 522*z* set at a distance of 16.62 cm from the registration wall 30. The outer array 524 includes a first sensor 524*a* set at a distance of 23.1 cm from the registration wall 30 and a last sensor 524*z* set at a distance of 25.0 cm from the registration wall 30. Those skilled in the art will recognize that other beginning and ending distances are possible.

Figure 3:
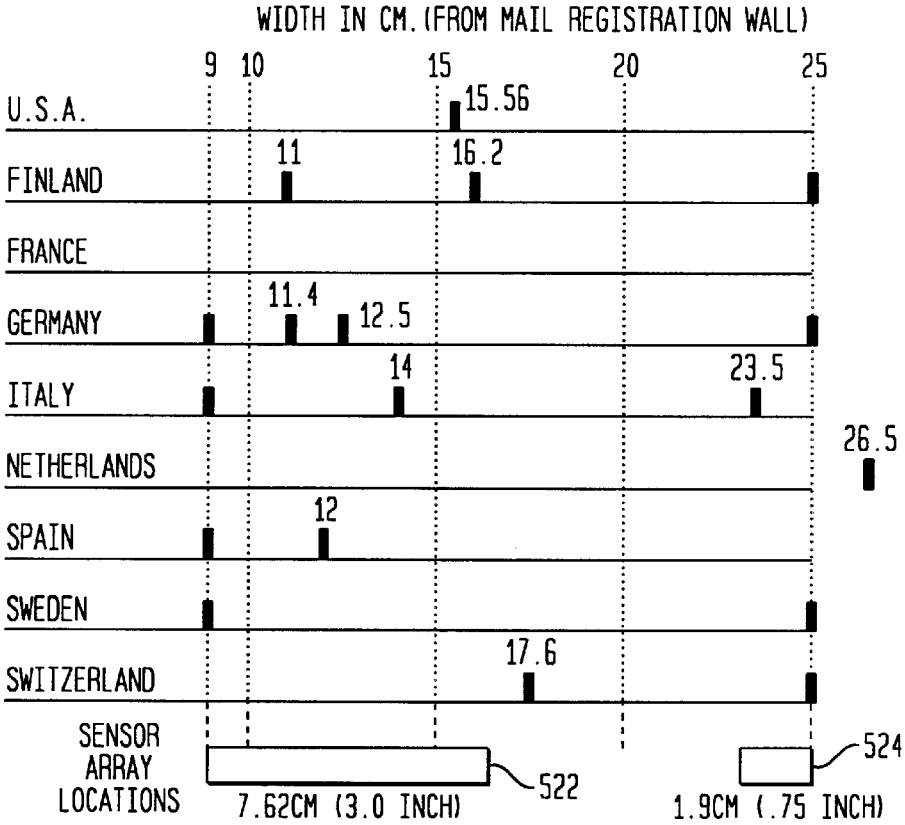
FIG. 3 is a graph showing the dimensional rating requirements of a plurality of different countries.

Referring primarily to FIG. 3 while recalling the structure of FIGS. 1 and 2, a graph indicating the dimensional rating requirements with respect to the width of the envelope 20 of various countries is shown as measured by the distance from the registration wall 30. Each point on the graph corresponds to an envelope width where the pricing for the respective postal authority changes. For example, the postal authority in the United States requires an additional charge of $0.10 for any envelope 20 having a width of 15.56 cm or greater. Other postal authorities have established price points at different widths. Additionally, most other postal authorities, such as Germany and Italy, have established a series of price points. However, the price points for the various countries are generally found in two groupings: (i) from 9.0 cm to 16.2 cm; and (ii) from 23.5 cm to 25.0 cm.

Referring to FIG. 1, the conveyor apparatus 200 includes an endless belt 210 looped around a drive pulley 220 and an encoder pulley 222 which is located downstream in the path of travel from the drive pulley 220 and proximate to the print head module 100. The drive pulley 220 and the encoder pulley 222 are substantially identical and are fixably mounted to respective shafts (not shown) which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively.

As described above, the normal force rollers 234 work to bias the envelope 20 up against the deck (not shown). This is commonly referred to as top surface registration which is beneficial for ink jet printing. Any variation in thickness of the envelope 20 is taken up by the deflection of the normal force rollers 234. Thus, a constant space is set between the envelope 20 and the print head module 100 no matter what the thickness of the envelope 20. The constant space is optimally set to a desired value to achieve quality printing. It is important to note that the deck (not shown) contains suitable openings for the endless belt 210 and normal force rollers 234.

A more detailed description of the conveyor apparatus 200 is found in U.S. patent application Ser. Co./No. 08/717,788; filed on Sep. 23, 1996, now U.S. Pat. No. 5,740,728 and entitled MAILING MACHINE.

The singulator module 400, conveyor apparatus 200, the print head module 100, the sensor module 500 and the sensor array module 520, as described above, are under the control of the micro control system 300 which may be of any suitable combination of microprocessors, firmware and software. The micro control system 300 includes a variety of subsystems or modules all of which are in communication with each other over any suitable communication pathway such as a bus 305. The micro control system 300 includes a motor controller 310 which is in operative communication with the motors 260 and 470 and a print head controller 320 which is in operative communication with the print head module 100. It is important to note that the singulator module 400 and the conveyor apparatus 200 have respective encoder systems which are in communication with the micro control system 300. In this manner, the micro control system 300 can monitor the performance of the singulator module 400 and the conveyor apparatus 200 and issue appropriate drive signals to motors 470 and 260, respectively.

Additionally, the micro control system 300 includes an accounting module 340, a rate module 350 and a sensor controller 330 which is in operative communication with both the sensor module 500 and the sensor array module 520. The sensor controller 330 selectively energizes the various light emitters of the sensor module 500 and the sensor array module 520 and receives as input the measurements from the respective light detectors. In this manner, the presence of the envelope 20 may be detected. A more detailed description of a suitable sensor controller which could be used in accordance with the present invention is described in U.S. Pat. No. 5,154,246 entitled SENSOR PROCESSOR FOR HIGH-SPEED MAIL-HANDLING MACHINE, the disclosure of which is specifically incorporated herein by reference.

The rate module 350 contains the necessary information pertaining to the rating system of the postal authority governing the location where the mailing machine 10 is installed. This rating system information includes the dimensional rating requirements of the postal authority. The accounting module 340 keeps track of the postal funds by maintaining a descending register which stores an amount of postage available for use and an ascending register which stores a total amount of postage dispensed over the life of the mailing machine 10. Postal funds may be added to the descending register by any conventional means.

Referring to FIG. 2, a sequence of envelopes 20*a*, 20*b* and 20*c* in transit through the mailing machine 10 is shown. The sequence of envelopes 20*a*, 20*b* and 20*c* are aligned along their top edge with registration wall 30 and are feed in the path of travel as indicated by arrow A by the singulator module 400 (not shown). Envelope 20*a* does not have sufficient width to reach the inner array 522 as it is fed along the deck 60. Therefore, none of the sensors in the inner array 522 will detect the presence of the envelope 20*a*. Therefore, it may be inferred that the width of the envelope 20*a* is less than 9.0 cm. As the envelope 20*b* is fed along the deck 60, it will extend over the inner array 522 but will not reach the last sensor 522*z* or the outer array 524. Thus, the width of the envelope 20*b* is between 9.0 cm and 16.62 cm. The exact width of the envelope 20*b* can be determined by cycling all the sensors in the inner array 522 to determine which ones are covered by the envelope 20*b*. Since the distance from the registration wall 30 to each sensor is known, the width of the envelope 20*b* can be readily determined. As the envelope 20*c* is fed along the deck 60, it will extend completely over the inner array 522 and will also cover a portion of the outer array 524. Thus, the width of the envelope 20*c* is between 23.1 cm and 25.0 cm. The exact width of the envelope 20*c* can be determined in similar fashion as that described for the envelope 20*b*.

It will be apparent to those skilled in the art that if the width of a subsequent envelope (not shown) is such that all the sensors of the inner array 522 are covered while none of the sensors of the outer array 524 are covered, then the width of the subsequent envelope is between 16.62 cm and 23.1 cm. Because there are no sensors in this range, the exact width of the envelope will not be known. However, there is generally a void in this range of price points as identified in the graph shown in FIG. 3.

It will also be apparent to those skilled in the art that if a further subsequent envelope covers all the sensors of the outer array 524, then the width of this envelope is greater than 25.0 cm. Because there are no sensors in this range, the exact width of the envelope will not be known. However, there is a complete void in this range of price points as identified in the graph shown in FIG. 3. Thus, the lack of sensors will have no impact on the ability of the mailing machine 10 to establish the proper amount of postage to apply.

Those skilled in the art will recognize that the inner array 522 and the outer array 524 have been sized and positioned accordingly to cover the vast majority of the price points identified in the graph of FIG. 3. Generally, the inner array 522 corresponds to a first grouping of price points between 9.0 cm and 16.2 cm while the outer array 524 corresponds to a second grouping of price points between 23.5 cm and 25.0 cm. In this manner, the cost of the overall sensor array module 500 is reduced because two smaller arrays, such as the inner array 522 and the outer array 524, are less expensive than a single array which extends from 9.0 cm to 25.0 cm.

Figure 4:
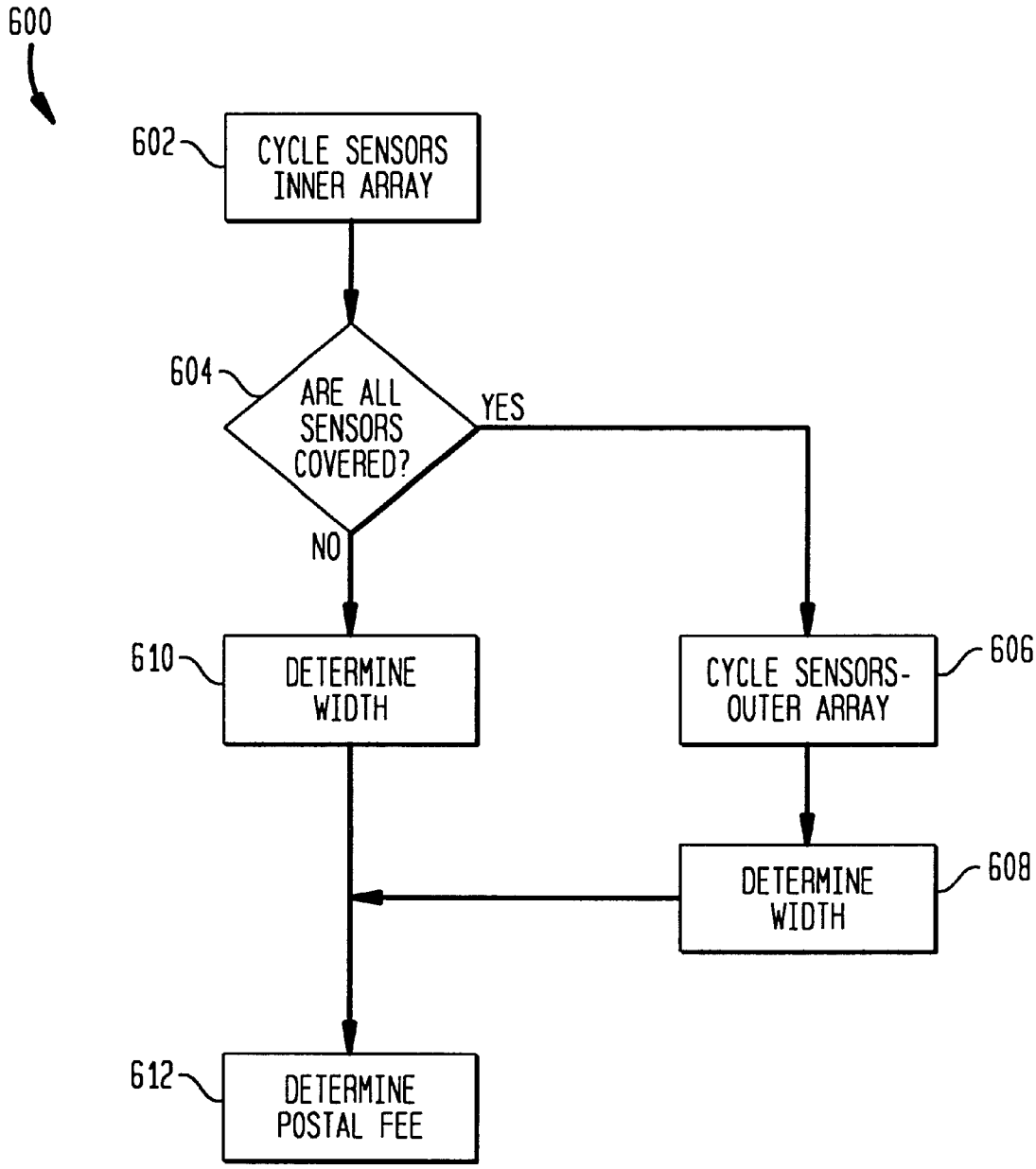
FIG. 4 is a flow chart showing the operation of the mailing machine in accordance with the first embodiment of the present invention.

With the structure of the mailing machine 10 described as above, the operational characteristics will now be described. Referring to FIG. 4 while referencing the structure of FIGS. 1 and 2, a flow chart 600 of the operation of the mailing machine 10 in accordance with the present invention is shown. At 602, the micro control system 300 cycles all the sensors of the inner array 522. Next, at 604, a determination is made as to whether or not all the sensors of the inner array 522 are covered. If so, then at 606 the micro control system 300 cycles all the sensors of the outer array 524. Next, at 608, the width of the envelope 20 is determined by repeatedly cycling the sensors of the outer array 524. If, at 604, all the sensors of the inner array 522 are not covered, then at 610 the width of the envelope 20 is determined by repeatedly cycling the sensors of the inner array 522. Once the width has been determined, either at 608 or 610, then the proper postal fee is determined at 612 by comparing the width to the information in the rate module 350.

Those skilled in the art will appreciate that repeatedly cycling the sensors in the respective arrays 522 and 524 will increase the reliability of the determined width. For example, the sensors can be cycled at different threshold values to account for variations in reflectivity over the surface of the envelope 20. Thus, dark zone (logos, writing, stray marks, etc.) on the envelope 20 will not cause erroneous results.

Those skilled in the art will further appreciate that since only one of the arrays 522 and 524 is repeatedly cycled to determine the width of the envelope 20, power consumption for the overall mailing machine 10 is reduced. Power consumption can be further reduced by only cycling the respective arrays 522 and 524 in the range where previous sensor cycles indicated the edge of the envelope 20.

Figure 5:
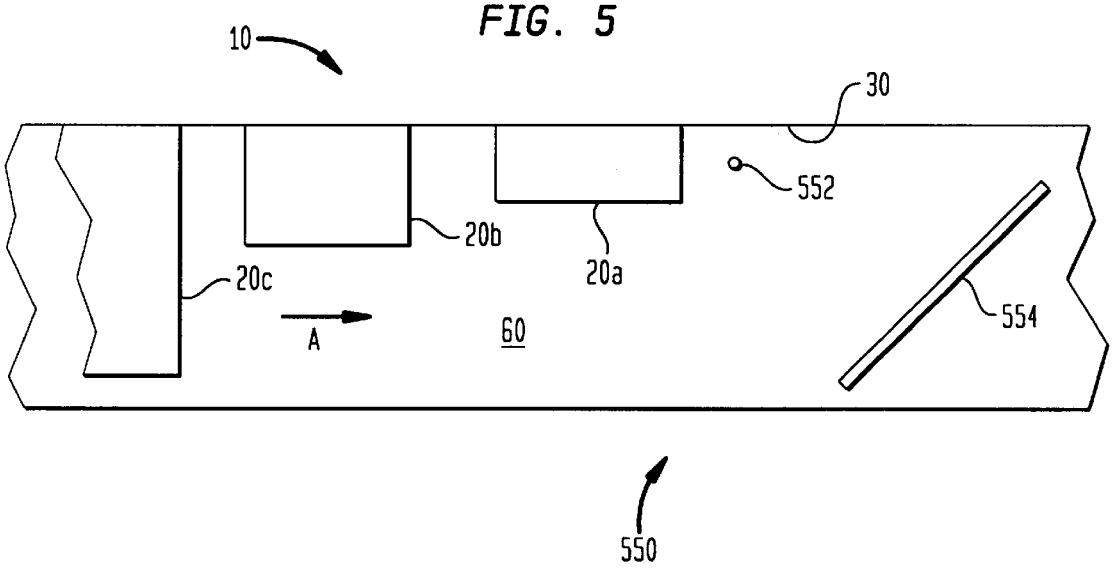
FIG. 5 is a simplified schematic of a plan view of a sequence of envelopes in transit through the mailing machine in accordance with a second embodiment of the present invention.

Referring to FIG. 5, a sequence of envelopes 20*a*, 20*b* and 20*c* in transit through the mailing machine 10 in accordance with a second embodiment of the present invention is shown. The sequence of envelopes 20*a*, 20*b* and 20*c* are aligned along their top edge with registration wall 30 and are feed in the path of travel as indicated by arrow A by the singulator module 400 (not shown). The mailing machine 10 includes a sensor assembly 550 including a sensor 552 and a sensor array 554 which are of the reflective type as discussed above. The sensor 552 is mounted flush with the deck 60 to detect the lead edge of the envelopes 20*a*, 20*b* and 20*c* as they are fed through the mailing machine 10. Located downstream from the sensor 552 is the sensor array 554 which is also mounted flush with the deck 60 and is positioned at an angle to the path of travel. It should now be apparent that each envelope 20*a*, 20*b* and 20*c* will contact the sensor array 554 at different points along the length of the sensor array 554 depending upon its width.

Figure 6:
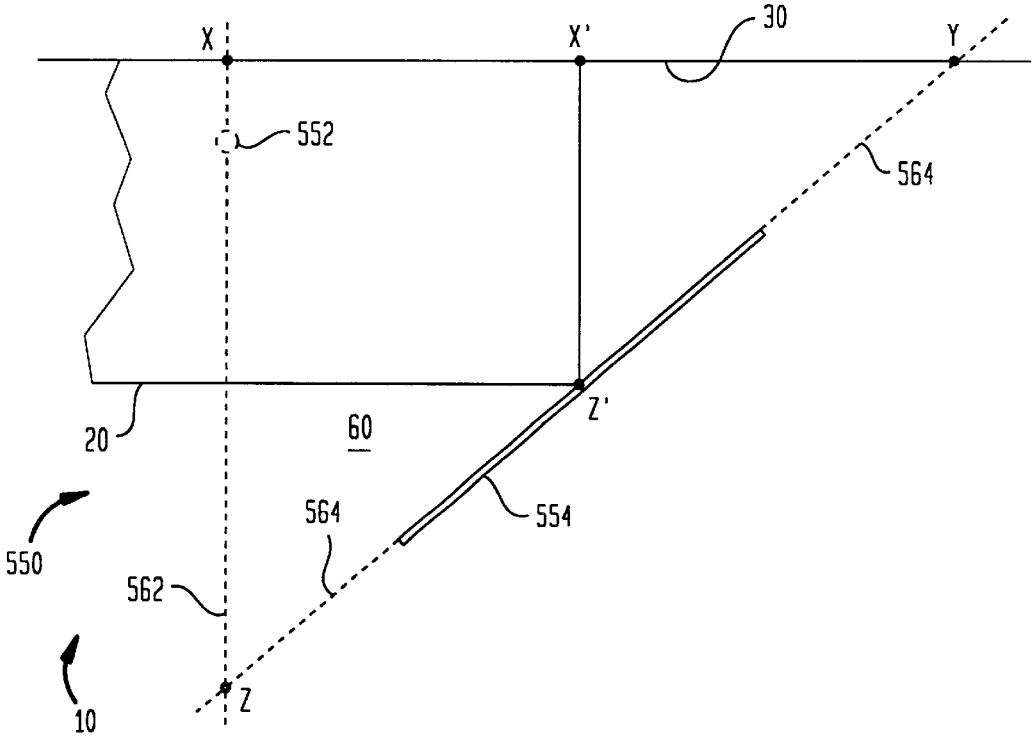
FIG. 6 is an enlarged plan view of an envelope in transit through the mailing machine in accordance with the second embodiment of the present invention.

Referring to FIG. 6, an enlarged plan view of the envelope 20 in transit through the mailing machine 10 is shown. A description of the geometric principles behind the operational characteristics of the second embodiment of the present invention will now be provided. Construction lines and reference points have been added to assist in the discussion. A first construction line 562 is drawn through the sensor 552 and orthogonal to the registration wall 30. The first construction line 562 intersects the registration wall 30 at a reference point X. A second construction line 564 extends along the length of and outward from the sensor array 554. The second construction line 564 intersects the registration wall 30 at a reference point Y while the intersection of the first construction line 562 and the second construction line 564 yields a reference point Z. Thus, a right triangle XYZ is formed. Since the distance XY and the angle of the sensor array 554 with respect to the registration wall 30 are fixed at predetermined dimensions, all the dimensions of the triangle XYZ are known.

The envelope 20 is shown just as the corner on the lead edge away from the registration wall 30 reaches the sensor array 554. In this position, reference points X' and Z' are created which yield another triangle X'YZ'. From standard geometric principles it is known that triangle XYZ and triangle X'YZ' are similar triangles. Thus, $$X'Y/XY=X'Z'/XZ \tag{1}$$

Solving for X'Z', the width of the envelope 20, and rearranging terms yields:

$$X'Z'=X'Y*[XZ/XY] \tag{2}$$

where the term XZ/XY may be set equal to a constant k1 because this term is fixed by the geometry of the sensor assembly 550 and the mailing machine 10. Performing this substitution yields:

$$X'Z'=X'Y*k\mathbf{1} \tag{3}$$

It is also known that:

$$X'Y=XY-XX' \tag{4}$$

Substituting equation (4) into equation (3) and multiplying out the terms yields:

$$X'Z'=k\mathbf{1}*XY-k\mathbf{1}*XX' \tag{5}$$

where the term k1*XY may be set equal to a constant k2 which is equal to the constant k1 multiplied by the distance XY which is fixed (known). Performing this substitution yields:

$$X'Z'=k\mathbf{2}-k\mathbf{1}*XX' \tag{6}$$

From equation (6), it should now be apparent that the width of the envelope 20 as defined by X'Z' is inversely proportional to the distance XX' which is equal to the distance that the envelope 20 travels from the sensor 552 until the envelope 20 is detected by the sensor array 554.

Referring to FIGS. 1 and 6, since the envelope 20 is under the positive control (no slippage) of the take-away rollers 450, the distance XX' can be measured using the motor 470, the motor controller 310, the sensor controller 330 and the sensor assembly 550. One way is using the sensor assembly 550 signals from the sensor 552 and the sensor array 554 to determine the distance XX' that the envelope 20 travels. The amount of time that passes between the lead edge detection by the sensor 552 and the corner detection by the sensor array 554, along with the speed at which the envelope 20 is being fed, can be used to determine the distance XX'.

Alternatively, an encoder system (not shown) can be used to measure the distance XX' by counting the number of encoder pulses between the lead edge detection by the sensor 552 and the corner detection by the sensor array 554. Since the encoder pulse has a known relationship to the amount of rotation of the take-away rollers 450 and thus the amount of travel of the envelope 20, the encoder pulses can be directly used to determine the distance XX'.

Generally, encoder systems are well known in the art and do not require further discussion for an understanding of the present invention. However, for the sake of clarity, a brief overview is provided below. In the preferred embodiment, the encoder system includes an encoder disk (not shown) fixably mount to an output shaft (not shown) the motor 470 and an encoder detector (not shown) fixably mounted to any suitable structure in the area of the motor 470. Thus, as the output shaft rotates so does the encoder disk. The encoder disk has a plurality of vanes located around its circumference and is of a conventional type, such as model number HP 5100 available from Hewlett-Packard Company. The encoder detector is also of the conventional type, such as model number HP 9100 available from Hewlett-Packard Company, and includes a light source (not shown) and a light detector (not shown). The encoder disk and the encoder detector are positioned with respect to each other so that the vanes of the encoder disk alternately block and unblock the light source as the shaft rotates. The transition from blocked to unblocked or vice versa results in a change of state (also commonly referred to as a "count") for the encoder detector.

Still another alternative is available if stepper motors are used. By counting the number of motor steps, which have a known relationship to the amount of rotation of the take-away rollers 450 and thus the amount of travel of the envelope 20, the distance XX' can be determined.

Using any of these techniques, the distance XX' can be determined. Then, the remaining elements of equation (6) are known and the distance X'Z', which is equivalent to the width of the envelope 20, can be directly obtained. In the preferred embodiment, a look-up table is provided in a memory portion (not shown) of the micro control system 300 which will convert time counts, encoder pulse counts or motor step counts, respectively, into envelope widths.

To improve the accuracy of the sensor assembly 550, it is important that field of view of the sensor array 554 be as narrow as possible and that the sensors along the sensor array 554 be as fine as possible. In this manner, only a small portion of the corner of the envelope 20 need cover the sensor array 554 to be detected. However, those skilled in the art will recognized that there are cost versus performance tradeoffs associated with increasingly finer resolution.

Many features of the preferred embodiment represent design choices selected to best exploit the inventive concept as implemented in a mailing machine. However, those skilled in the art will recognize that various modifications can be made without departing from the spirit of the present invention. For example, referring to FIGS. 1 and 5, the sensor array 554 may be replaced with a single sensor (not shown) and a light pipe (not shown). The light pipe would occupy the same position and space on the deck 60 as the sensor array 554 which the single sensor centrally located thereon. The light which is reflected from the envelope 20 back toward the light pipe would be carried to the single sensor by fiber optics or any other suitable devices. In this manner, a single sensor in combination with the light pipe could be substituted for the sensor array 554. Thus, the sensor array 554 and the single sensor/light pipe assembly may be referred to generically as a sensor line.

Therefore, the inventive concept in its broader aspects is not limited to the specific details of the preferred embodiment but is defined by the appended claims and their equivalents.

What is claimed is:

1. A mailing machine comprising:

rate means for storing dimensional rating information for a postal authority, the rating information defining a proper amount of postage for an envelope;

a transport system for feeding the envelope in a path of travel;

a registration wall along which a top edge of the envelope is aligned during feeding in the path of travel;

a sensor system disposed along the path of travel so as to detect the presence of the envelope;

means for applying the proper amount of postage to the envelope; and a control system in operative communication with the rate means, the transport system and the sensor system, the control system being for determining a width for the envelope within a predetermined range of widths and using the width and the rate means determining the proper amount of postage for the envelope;

and wherein:

the predetermined range of widths begins at a dimension approximately 9 cm from the registration wall and ends before a dimension approximately 26.5 cm from the registration wall, wherein, the sensor system includes a first sensor for detecting a lead edge of the envelope and a sensor line located downstream in the path of travel from the first sensor and at an angle to the path of travel so as to detect a lead corner of the envelope.

2. The mailing machine of claim 1, wherein:

once the first sensor detects the lead edge of the envelope, the control system commences a count indicative of the distance which the envelope travels;

once the sensor line detects the lead corner of the envelope, the control system uses the count to determine the width of the envelope.

3. A method of operating a mailing machine, the method comprising:

feeding an envelope in a path of travel;

feeding the envelope along a registration wall so that a top edge of the envelope is aligned with the registration wall during feeding in the path of travel;

detecting the presence of the envelope along the path of travel;

determining a width for the envelope within a predetermined range of widths;

using the width and rating information for a postal authority to determine a proper amount of postage for the envelope; and applying the proper amount of postage to the envelope; and wherein:

the predetermined range of widths begins at a dimension approximately 9 cm from the registration wall and ends before a dimension approximately 26.5 cm from the registration wall, further including, feeding the envelope past a first sensor for detecting a lead edge of the envelope and a sensor line located downstream in the path of travel from the first sensor and at an angle to the path of travel so as to detect a lead corner of the envelope.

4. The method of claim 3 further comprising the step(s) of:

once the first sensor detects the lead edge of the envelope, commencing a count indicative of the distance which the envelope travels.

* * * * *